US010668527B2

(12) United States Patent
Pezzoli

(10) Patent No.: US 10,668,527 B2
(45) Date of Patent: Jun. 2, 2020

(54) DIE-CASTING MACHINE WITH AUTOMATIC AIR PURGE SYSTEM

(71) Applicant: ITALPRESSE INDUSTRIE S.P.A., Brescia (IT)

(72) Inventor: Andrea Pezzoli, Brescia (IT)

(73) Assignee: ITALPRESSE INDUSTRIE S.P.A., Brescia (IT)

( * ) Notice: Subject to any disclaimer, the term of this patent is extended or adjusted under 35 U.S.C. 154(b) by 0 days.

(21) Appl. No.: 16/485,779

(22) PCT Filed: Apr. 11, 2018

(86) PCT No.: PCT/IB2018/052548
§ 371 (c)(1),
(2) Date: Aug. 13, 2019

(87) PCT Pub. No.: WO2018/189702
PCT Pub. Date: Oct. 18, 2018

(65) Prior Publication Data

US 2020/0047244 A1 Feb. 13, 2020

(30) Foreign Application Priority Data

Apr. 14, 2017 (IT) ..... 102017000042094

(51) Int. Cl.
*B22D 17/32* (2006.01)
*B22D 17/10* (2006.01)
*B22D 17/20* (2006.01)

(52) U.S. Cl.
CPC ..... *B22D 17/32* (2013.01); *B22D 17/10* (2013.01); *B22D 17/203* (2013.01)

(58) Field of Classification Search
CPC .. B22D 17/10; B22D 17/2015; B22D 17/203; B22D 17/32; B29C 45/76
See application file for complete search history.

(56) References Cited

U.S. PATENT DOCUMENTS 5,957,192 A 9/1999 Kitamura et al.
6,241,003 B1 6/2001 Kodama et al.
2003/0041998 A1* 3/2003 Suzuki ..... B22D 17/007 164/457

(Continued)

FOREIGN PATENT DOCUMENTS

CA 2304407 A1 10/2001
EP 2942127 A1 11/2015

OTHER PUBLICATIONS

International Search Report and Written Opinion, dated Jun. 20, 2018, for the corresponding International Application No. PCT/IB2018/052548 in 10 pages.

*Primary Examiner* — Kevin E Yoon
(74) *Attorney, Agent, or Firm* — Polsinelli PC

(57) ABSTRACT

An injection assembly (1) of a die casting machine comprises valve means for controlling the advancement and return of the injection piston (20) and of the multiplier piston (42). The valve means comprise a plurality of valves, including a proportional delivery valve (104), a proportional injection discharge valve (112) and a proportional multiplier valve (118). Electronic control means (300) are provided which are configured and/or programmed to execute an air purge cycle which performs the opening and closing of the valves, alternately, for a predetermined number of times.

9 Claims, 7 Drawing Sheets

(56) References Cited

U.S. PATENT DOCUMENTS

| | | | | |
|---|---|---|---|---|
| 2005/0056978 | A1* | 3/2005 | Fujikawa ..... | B22D 17/10<br>266/200 |
| 2005/0172797 | A1 | 8/2005 | Bair | |

* cited by examiner

DIE-CASTING MACHINE WITH AUTOMATIC AIR PURGE SYSTEM

The present invention relates to a die casting machine with hydraulic control, in particular for the casting of light alloys. In particular, the present invention relates to an injection assembly of the machine, provided with valves for controlling the injection process, provided with an automatic air purge system from the valves.

As is known, these machines operate on a mold, consisting of two half-molds which can be coupled to form the cavity corresponding to the piece to be made, and consist of a closure assembly for the mold and an injection assembly, provided with an injection piston to press the molten metal cast into the mold.

For the operation of the injection piston and for further process control activities, a hydraulic circuit is provided which is regulated by numerous valves.

During maintenance work, some valves are disassembled from the machine, cleaned and fitted again.

When necessary, however, they are replaced with new valves.

Consequently, air pockets are found inside these valves, which must be expelled to ensure the correct operation of the valve itself.

Currently, for the expulsion of these pockets, a manual intervention is required, which implies physical access to the valve, very often not easy, and the execution of some operations.

The object of the present invention is to provide a hydraulically driven die casting machine provided with an automatic air purge system of the valves.

Such an object is achieved by a die casting machine implemented according to claim 1. The dependent claims describe further embodiments of the invention.

Figure 1:
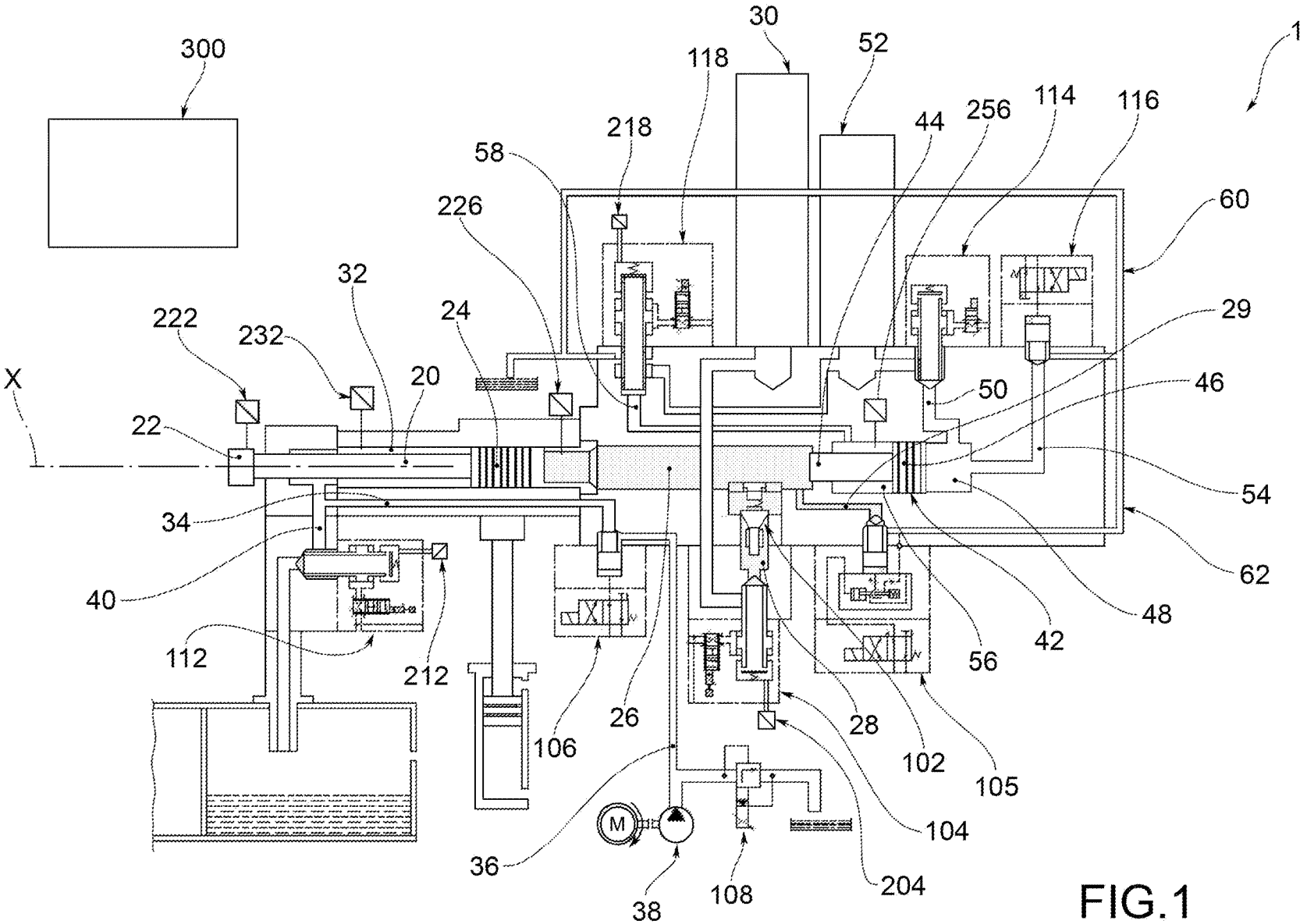

The features and the advantages of the die casting machine according to the present invention will appear more clearly from the following description, made by way of an indicative and non-limiting example with reference to the following figures, in which:

FIG. 1 shows a functional diagram of an injection assembly of a die casting machine, provided with valves for controlling the process, according to an embodiment of the present invention;

FIGS. 2*a* and 2*b*, 3*a* and 3*b*, 4*a* and 4*b* show flow diagrams of purge cycles.

With reference to FIG. 1, reference numeral 1 indicates as a whole an injection assembly of a die casting machine with a hydraulic drive.

The injection assembly 1 comprises an injection piston 20 extending along a translation axis X between a head end 22 and an opposing tail end 24. The injection piston 20 can be moved along the said translation axis X by means of a hydraulic drive.

The injection assembly 1 also has a main pressure chamber 26, upstream of the injection piston 20, i.e. upstream of the tail end 24 thereof, for containing and pressing the fluid intended for translation at the outlet of the injection piston 20.

Furthermore, the injection assembly 1 comprises a main fluid inlet 28 and a check valve 102 located between the main inlet 28 and the main chamber 26 and adapted to prevent the return of fluid from the main chamber 26 to the main inlet 28.

For example, said check valve 102 is implemented according to the teaching contained in document EP-A1-2942127 on behalf of the Applicant.

The machine further comprises a first accumulator 30 (which can be charged from a relative cylinder, for example containing nitrogen under pressure) for the injection piston 20 control circuit. Said first accumulator 30 is connected upstream of the main inlet 28 and a proportional delivery valve 104 operates between said accumulator 30 and said main inlet 28.

Said delivery valve 104 is electronically controlled and has feedback via a position transducer 204 adapted to detect a signal according to the valve opening.

The main pressure chamber 26 is also connected to an injection discharge 29 connected to discharge, along which an injection discharge check valve 105 is operative.

The injection assembly 1 further comprises a main back pressure chamber 32, downstream of the tail end 24 of the injection piston 20, connected to a return inlet 34 for supplying pressurized fluid for the return translation of the injection piston 20.

The return inlet 34 is connected upstream with a pump delivery 36, upstream of which a pump 38 is located, typically driven by an electric motor.

An injection check valve 106 is arranged between the pump delivery 36 and the return inlet 34.

Furthermore, a proportional pump maximum pressure valve 108 is arranged branching off the pump delivery 36 and connected to discharge, for regulating the pressure at the outlet of the pump 38.

In addition, the main back pressure chamber 32 is connected to a return discharge 40 connected to discharge, along which a proportional injection discharge valve 112 is arranged, electronically controlled and provided with a position transducer 212 adapted to emit a signal as a function of the opening of said valve.

Furthermore, the injection assembly 1 comprises pressure multiplier means adapted to increase the pressure of the fluid contained in the main chamber 26, above the pressure supplied by the accumulator 30.

Said multiplier means comprise a multiplier piston 42 which extends along a multiplier axis Y, for example coincident with the translation axis X of the injection piston 20, between a head end 44, adapted to operate in compression in the main chamber 30, and an opposite tail end 46.

The multiplier piston 42 is translatable on command along the multiplier axis Y.

The pressure multiplier means further comprise a secondary pressure chamber 48, upstream of the multiplier piston 42, and a secondary fluid inlet 50, upstream of the secondary chamber 100, for the inlet of fluid under pressure.

The machine further comprises a second accumulator 52 (with relative refill cylinder) which can be connected to the secondary inlet 50 and a multiplier release valve 114 is arranged between the second accumulator 52 and the secondary inlet 50.

The secondary pressure chamber 48 is also connected to a multiplier return discharge 54 connected to discharge, along which a multiplier discharge check valve 116 is arranged.

Moreover, the multiplier means comprise a secondary back pressure chamber 56 downstream of the tail end 46 of the multiplier piston 42, which can be connected to the second accumulator 52 via a secondary return inlet 58.

Along said return secondary inlet 58, between the second accumulator 52 and the secondary back pressure chamber 56, a proportional main multiplier valve 118 is operative, electronically controllable and provided with a position transducer 218 adapted to emit a signal as a function of the opening of the valve.

Finally, a first auxiliary section 60 connects the multiplier discharge check valve 116 to the main multiplier valve 118, and is placed to discharge, and a second section 62 connects the multiplier discharge check valve 116 to the injection discharge check valve 105.

Furthermore, the injection assembly 1 comprises an injection piston position sensor 220, for example an encoder, for detecting the position of the injection piston 20;

a back pressure main chamber pressure transducer 232, for detecting the pressure in the main back pressure chamber 32;

a pressure main chamber pressure transducer 226, for detecting the pressure in the main pressure chamber 26;

a back pressure secondary chamber pressure transducer 256, for the detection of the pressure in the secondary back pressure chamber 56.

The die casting process provides a first injection step, in which the injection piston 20 advances at reduced speed, to allow the molten metal to fill the accessory channels provided in the mold.

For the first injection step, for controlled partial opening of the delivery valve 104, the pressurized fluid is fed to the main inlet 28, for example at a nominal pressure of 150 bar, and from this to the main pressure chamber 30 as a result the opening of the check valve 102.

By the controlled opening of the injection discharge valve 112, the main back pressure chamber 32 is set to discharge, so that the action of the fluid in the main pressure chamber 30 and the opposite action of the fluid in the main back pressure chamber 32 generate a thrust in output on the injection piston 20 at the desired speed.

Thereafter, preferably without interruption with the previous step, the process provides a second injection step, in which the injection piston 20 advances at a higher speed than the advancement speed of the first step.

For the second injection step, for the further controlled opening of the delivery valve 104, for example total, the pressurized fluid is fed to the main inlet 28 at a greater flow rate, and from there to the main pressure chamber 30 as a result of the opening of the check valve 102.

Moreover, preferably, by the further controlled opening of the injection discharge valve 112, the main back pressure chamber 32 is set to discharge, so that the action of the fluid in the main pressure chamber 30 and the opposite action of the fluid in the main back pressure chamber 32 generate a thrust in output on the injection piston 20 at the desired high speed.

Thereafter, preferably without interruption with the previous step, the process provides a third injection step, in which the injection piston has almost zero speed but exerts a high thrust on the molten metal, to force the molten metal, now in solidification, to recover the contraction undergone by cooling.

For the third injection step, the pressure multiplier means are activated.

In particular, the pressurized fluid is fed to the secondary inlet 50 and from there to the secondary pressure chamber 48 following the controlled opening of the multiplier release valve 114. The secondary back pressure chamber 56 is fed with pressurized fluid in a controlled manner through the main multiplier valve 118, so that the multiplier piston 42 exerts a thrust action on the fluid present in the main pressure chamber 30, increasing the pressure thereof, for example up to 500 bar.

As a consequence of this, the check valve 102, sensitive to the pressure difference between the main inlet 40 and the main pressure chamber 30, switches to the closed configuration, fluidly separating the main inlet 40 and the main pressure chamber 30.

The fluid in the main pressure chamber 30, brought to high pressure, then operates on the injection piston 20, so that said piston exerts the desired recovery action of the contractions on the metal in the mold.

Once the third injection step has ended, the multiplier means are deactivated; in particular, the multiplier piston 42 performs a return stroke by virtue of the pressurized fluid fed to the secondary back pressure chamber 56 and to the discharge connection of the secondary pressure chamber 48 due to the opening of the multiplier discharge check valve 116.

Furthermore, the injection piston 20 performs a return stroke by virtue of the pressurized fluid fed to the main back pressure chamber 32 through the return inlet 34 and the pump delivery 36 by opening the injection check valve 106, and the connection to discharge of the main pressure chamber 30 to open the injection discharge check valve 105.

The machine further comprises control means 300, comprising for example an electronic control unit or a programmable PLC or a microprocessor, operatively connected with said valves and/or with said sensors and/or transducers, for controlling the opening and closing of said valves as a function of the signals emitted by said sensors and/or said transducers and/or as a function of a predetermined control program.

According to the invention, the machine is provided with an automatic purge system, operating through said control program, to perform a purge cycle, during which any air pockets contained in a valve body of a valve are expelled.

Said purging cycle provides to perform a plurality of times, alternately, the opening and closing of the valve, preferably in a complete manner.

In this way, the alternate and repeated movement of the main valve element, for example the distribution drawer, produces the effect of expelling air from the cavities inside the valve body.

Preferably, the air is removed together with the fluid exiting the valve body, towards the drain or the oil tank.

Purge Cycle of the Delivery Valve

According to an embodiment of the invention, the purge system provides for the execution of a purge cycle of the delivery valve 104.

Said purge cycle of the delivery valve provides for the initial step of checking the initial conditions for the execution of the delivery valve purge.

For example, said initial conditions are:

1) injection discharge valve 112 with enable=ON and control voltage=0 Volt;

2) delivery valve 104 with enable=ON and control voltage=0 Volt;

3) main multiplier valve 118 with enable=ON and control voltage=0 Volt;

4) injection discharge valve feedback 112<threshold value, i.e. said valve is closed;

5) delivery valve feedback 104<threshold value, i.e. said valve is closed;

6) main multiplier valve feedback 118 between threshold values, i.e. said valve is closed;

7) multiplier release valve 114 not controlled;

8) injection return delivery valve 105 not controlled, i.e. the delivery chamber is to discharge;

9) injection return valve 106 not controlled;

10) multiplier return discharge valve 116 OFF, i.e. the head-side chamber is to discharge;

11) delivery pressure (measured by the main chamber pressure transducer 226)<threshold value, i.e. absence of pressure in the main pressure chamber 26;
12) injection piston 20 in retracted limit position;
13) safety doors to access the injection area closed.

If the initial conditions are met, the purge cycle performs an operating purge cycle, which provides for the opening, preferably complete, and the closing, preferably complete, alternately, for a predetermined number, of the delivery valve 104.

Figure 2A:
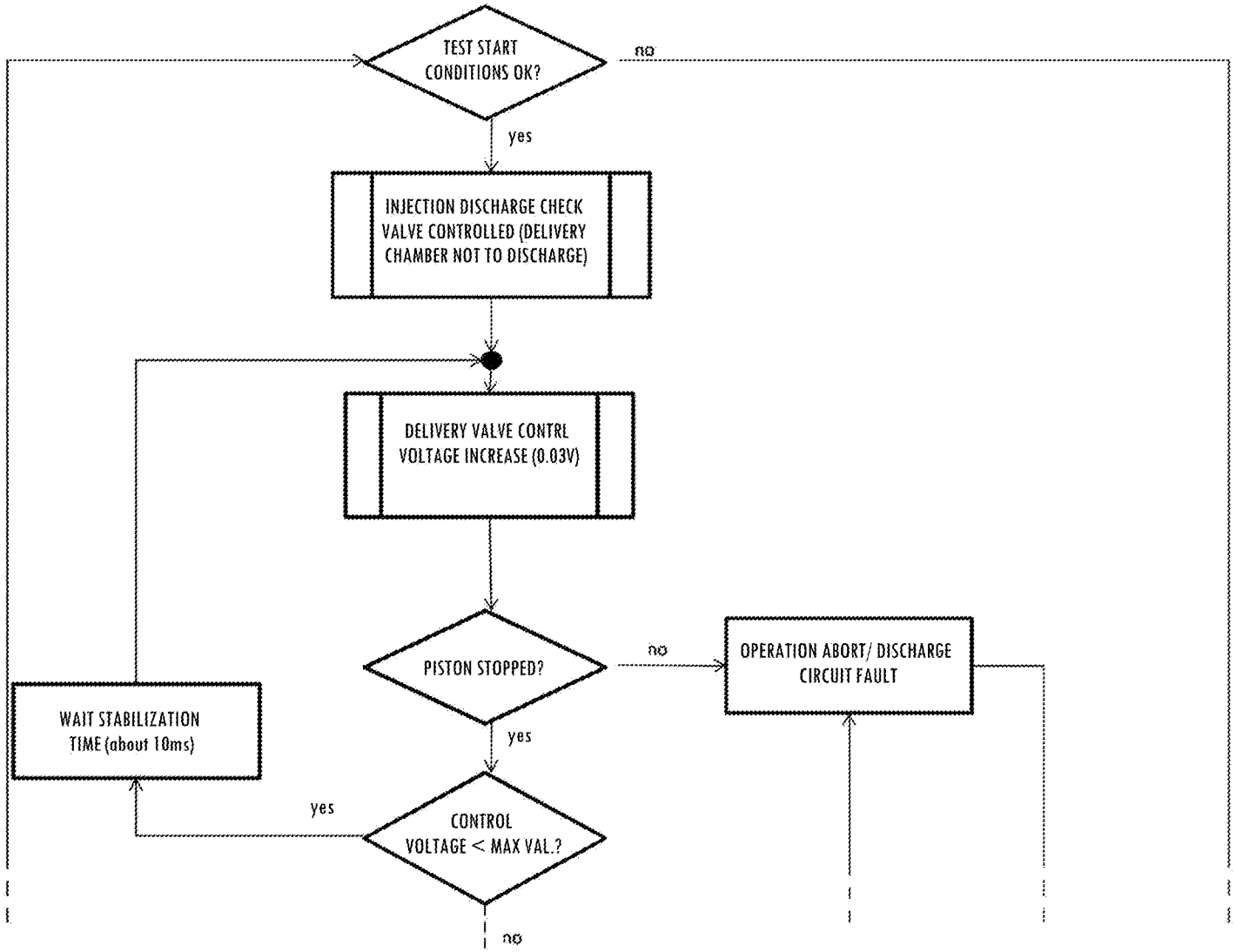
Figure 2B:
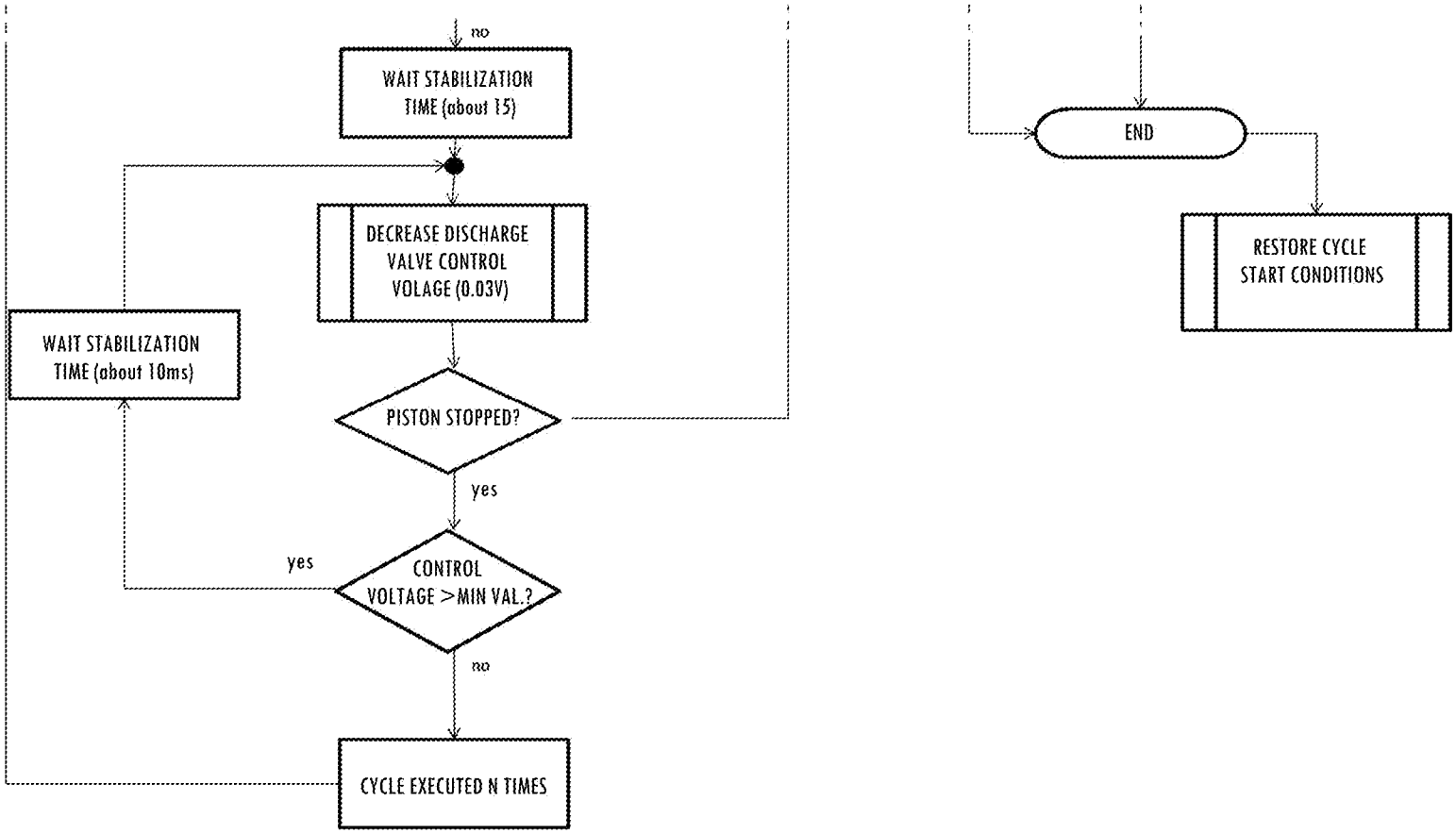

In particular, this operating cycle operates according to the flowchart in FIGS. 2*a* and 2*b*.

Purge Cycle of the Injection Discharge Valve

According to a further embodiment of the invention, the purge system provides for the execution of a purge cycle of the injection discharge valve 112.

Said purge cycle of the delivery valve provides for the initial step of checking the initial conditions for the execution of the injection discharge valve purge.

For example, said initial conditions are:
1) injection discharge valve 112 with enable=ON and control voltage=0 Volt;
2) delivery valve 104 with enable=ON and control voltage=0 Volt;
3) main multiplier valve 118 with enable=ON and control voltage=0 Volt;
4) injection discharge valve feedback 112<threshold value, i.e. said valve is closed;
5) delivery valve feedback 104<threshold value, i.e. said valve is closed;
6) main multiplier valve feedback 118 between threshold values, i.e. said valve is closed;
7) multiplier release valve 114 not controlled;
8) injection return delivery valve 105 not controlled, i.e. the delivery chamber is to discharge;
9) injection return valve 106 not controlled;
10) multiplier return discharge valve 116 OFF, i.e. the head-side chamber is to discharge;
11) delivery pressure (measured by the main chamber pressure transducer 226)<threshold value, i.e. absence of pressure in the main pressure chamber 26;
12) injection piston 20 in retracted limit position;
13) safety doors to access the injection area closed.

If the initial conditions are met, the purge cycle performs an operating purge cycle, which provides for the opening, preferably complete, and the closing, preferably complete, alternately, for a predetermined number, of the injection discharge valve 112.

Figure 3A:
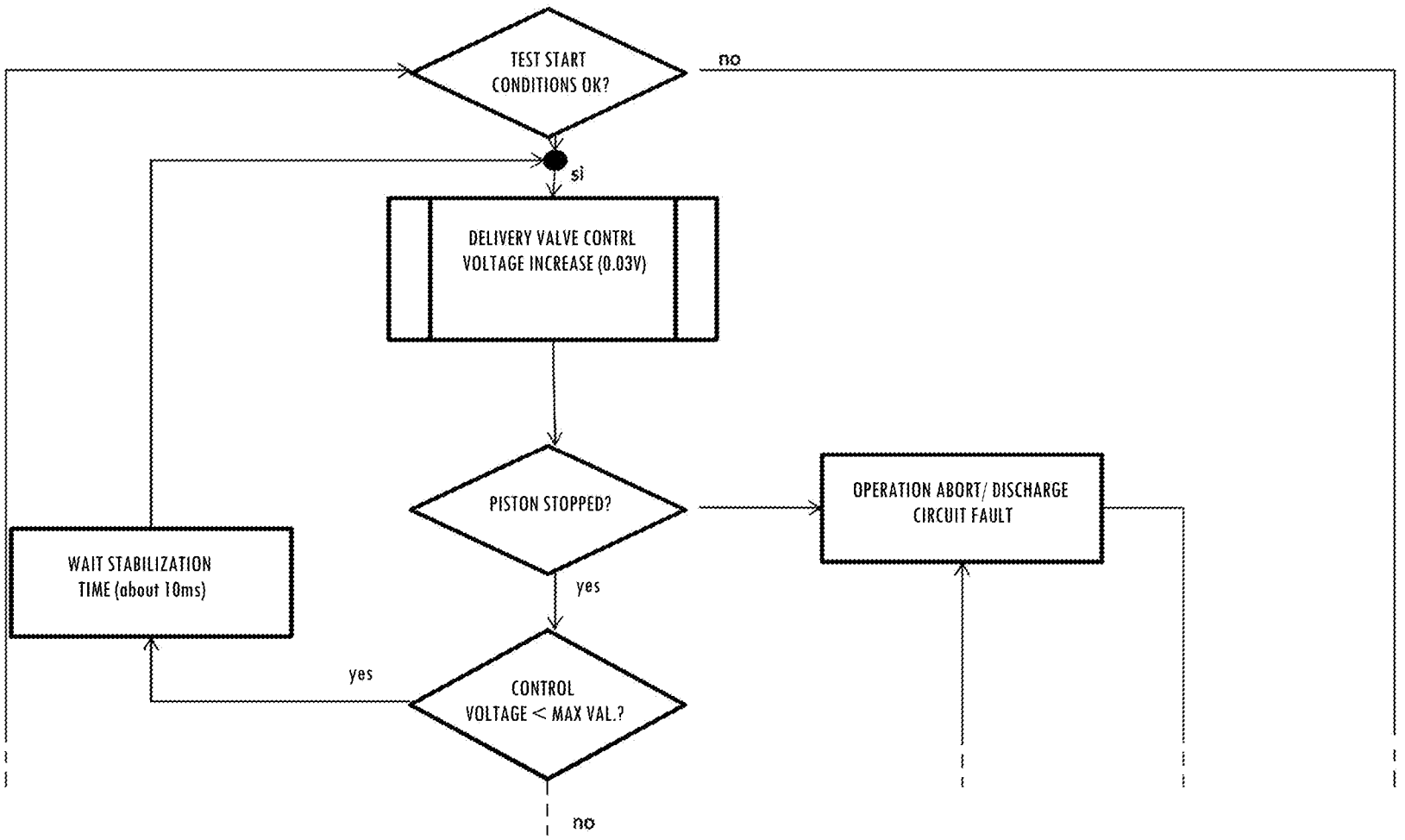
Figure 3B:
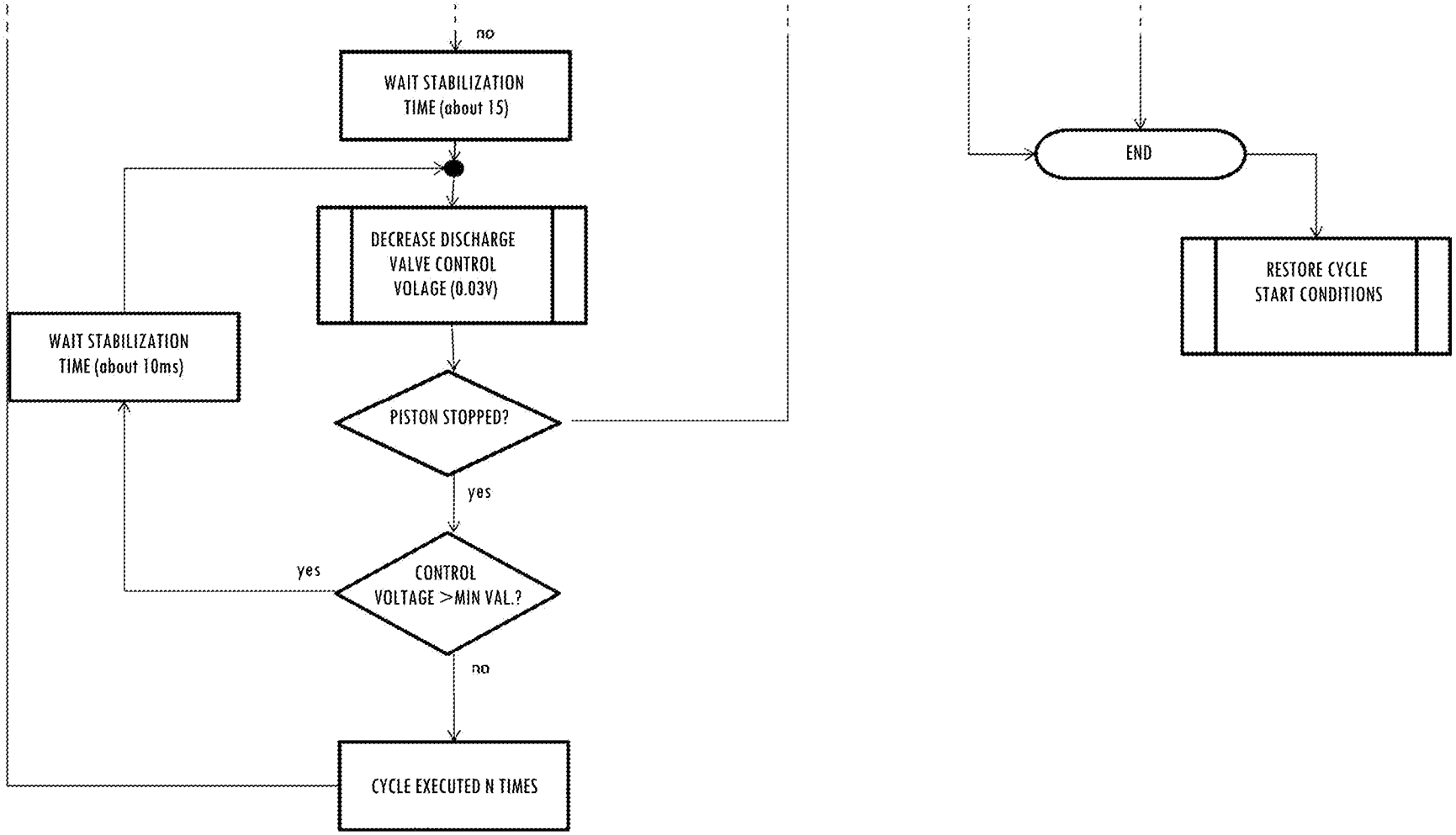

In particular, this operating cycle operates according to the flowchart in FIGS. 3*a* and 3*b*.

Purge Cycle of the Main Multiplier Valve

According to a further embodiment of the invention, the purge system provides for the execution of a purge cycle of the main multiplier valve 118.

Said purge cycle of the main multiplier valve provides for the initial step of checking the initial conditions for the execution of the main multiplier valve purge.

For example, said initial conditions are:
1) injection discharge valve 112 with enable=ON and control voltage=0 Volt;
2) delivery valve 104 with enable=ON and control voltage=0 Volt;
3) main multiplier valve 118 with enable=ON and control voltage=0 Volt;
4) injection discharge valve feedback 112<threshold value, i.e. said valve is closed;
5) delivery valve feedback 104<threshold value, i.e. said valve is closed;
6) main multiplier valve feedback 118 between threshold values, i.e. said valve is closed;
7) multiplier release valve 114 not controlled;
8) injection return delivery valve 105 not controlled, i.e. the delivery chamber is to discharge;
9) injection return valve 106 not controlled;
10) multiplier return discharge valve 116 OFF, i.e. the head-side chamber is to discharge;
11) delivery pressure (measured by the main chamber pressure transducer 226)<threshold value, i.e. absence of pressure in the main pressure chamber 26;
12) injection piston 20 in retracted limit position;
13) safety doors to access the injection area closed.

If the initial conditions are met, the purge cycle performs an operating purge cycle, which provides for the opening, preferably complete, and the closing, preferably complete, alternately, for a predetermined number, of the main multiplier valve 118.

Figure 4A:
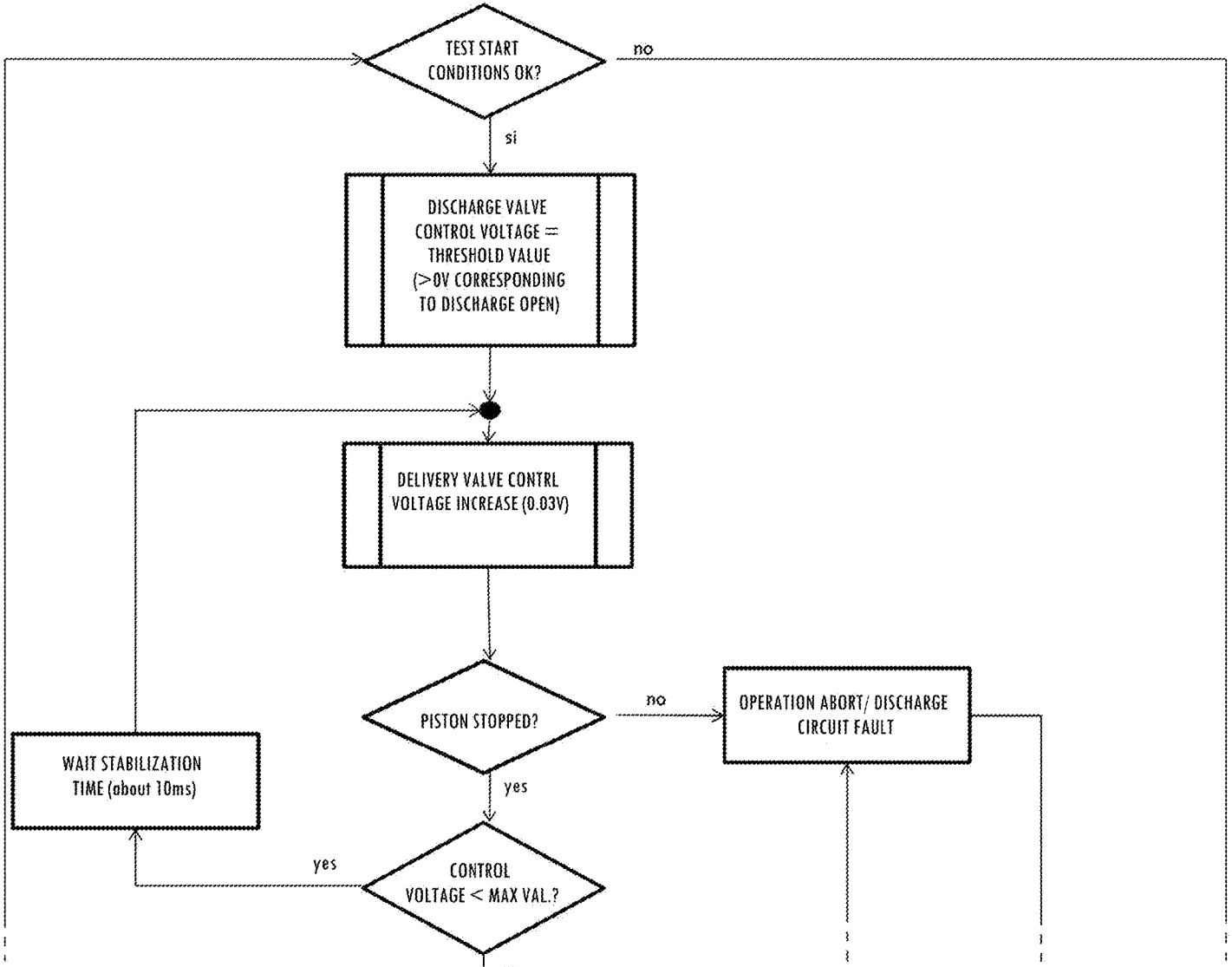
Figure 4B:
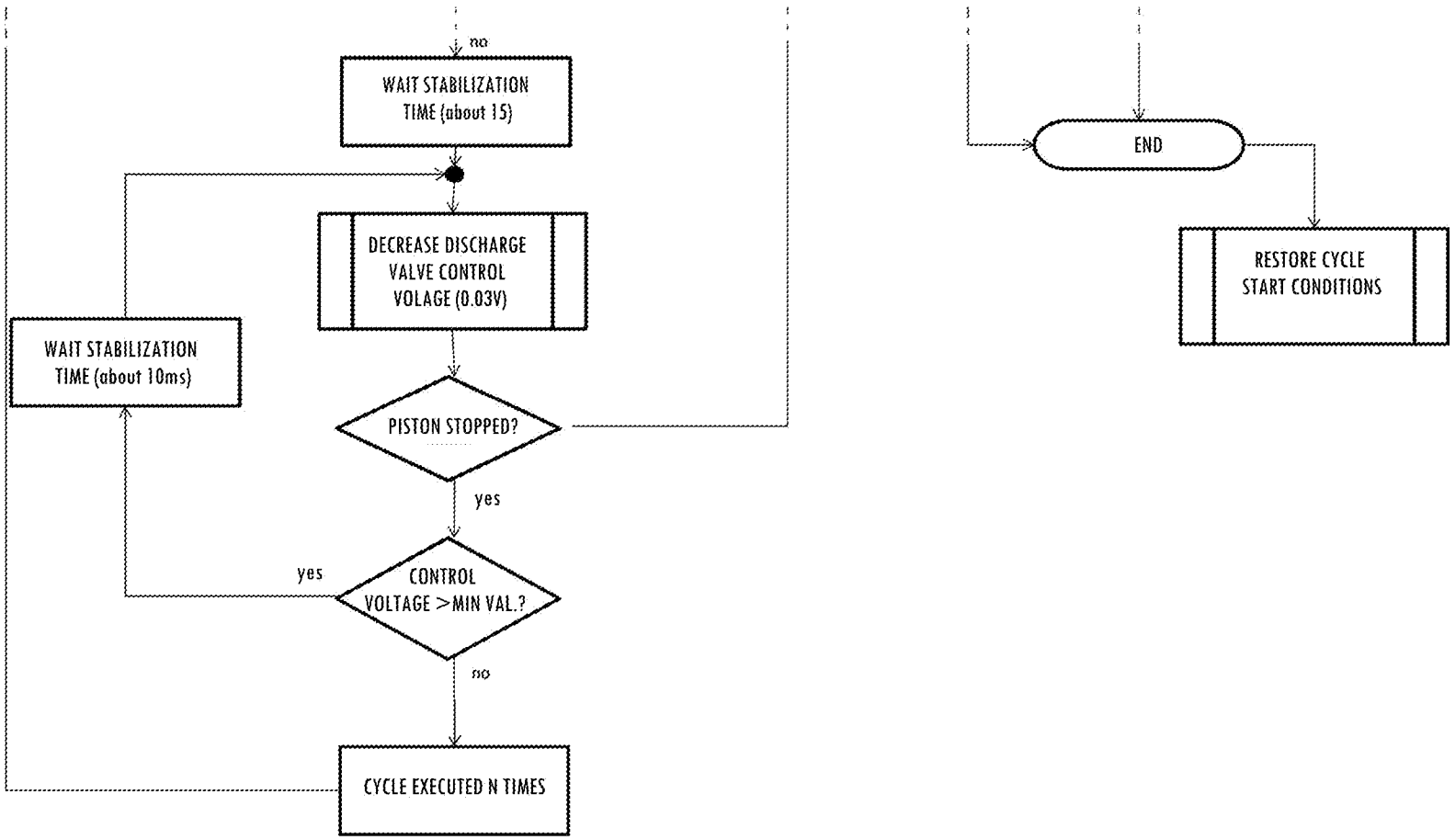

In particular, this operating cycle operates according to the flowchart in FIGS. 4*a* and 4*b*.

Moreover, said control means 300 comprise display means, for example comprising a screen or a display, to display the result of each cycle, highlighting the correct execution of the cycle or an incorrect execution or the impossibility of executing the cycle.

The injection assembly according to the present invention overcomes the drawbacks referred to with reference to the prior art, as it allows performing a purge cycle automatically, without having to physically access the valves.

It is clear that a man skilled in the art can make changes to the injection assembly described above in order to meet incidental needs, all falling within the scope of protection defined in the following claims.

The invention claimed is:

1. An injection assembly of a die casting machine, comprising:

an injection piston, controllable in translation for working on mold cast metal in a mold of the machine, and a main pressure chamber for containing and pressurizing a fluid for the translation of the injection piston;

a multiplier piston hydraulically controllable to increase a fluid pressure in the main pressure chamber;

at least one valve for controlling the advance and return of the injection piston and the multiplier piston, wherein the at least one valve comprises at least one of: a proportional, electronically controllable delivery valve with feedback via a position transducer, an injection discharge check valve, an injection check valve, a proportional, electrically controllable, injection discharge valve with feedback via a position transducer, a multiplier release valve, a multiplier discharge check valve, a proportional, electronically controllable, main multiplier valve with feedback via a position transducer; and an electronic control operatively connected to the at least one valve and to the transducers for controlling an opening and closing of the at least one valve, the electronic control configured with a predetermined control program comprising an execution program for an air purge cycle that alternately opens and closes the at least one valve for a predetermined number of times.

2. The injection assembly according to claim 1, wherein the air purge cycle provides for a complete opening of the at least one valve and/or complete closing of the at least one valve.

3. The injection assembly according to claim 1, wherein at least one the valve during the purge cycle is configured to expel the air toward a fluid outlet duct from a valve body.

4. The injection assembly according to claim 1, wherein the purge cycle execution program preliminarily provides for checking the initial conditions for purging the at least one valve.

5. The injection assembly according to claim 1, wherein the purge cycle is executed for the delivery valve.

6. The injection assembly according to claim 1, wherein the purge cycle is executed for the injection discharge valve.

7. The injection assembly according to claim 1, wherein the purge cycle is executed for the main multiplier valve.

8. A control method for controlling an injection assembly of a die casting machine, wherein the injection assembly comprises at least one valve for controlling an advance and return of an injection piston and a multiplier piston;

the method comprising at least one air purge step for alternately opening and closing the at least one valve for a predetermined number of times.

9. The control method according to claim 8, wherein prior to the air purge step a preliminary step is performed which provides for a verification of predetermined initial conditions.

* * * * *